US006585033B2

(12) United States Patent
Nishida et al.

(10) Patent No.: US 6,585,033 B2
(45) Date of Patent: Jul. 1, 2003

(54) PROCESS FOR PRODUCING VANADIUM ALLOY FOIL

(75) Inventors: Motonori Nishida, Kyoto (JP); Akira Takagi, Kyoto (JP); Toshiki Ohnishi, Kyoto (JP); Osamu Kajita, Uji (JP)

(73) Assignee: Fukuda Metal Foil & Powder Co., Ltd., Kyoto (JP)

( * ) Notice: Subject to any disclaimer, the term of this patent is extended or adjusted under 35 U.S.C. 154(b) by 0 days.

(21) Appl. No.: 10/076,356

(22) Filed: Feb. 19, 2002

(65) Prior Publication Data

US 2002/0157806 A1 Oct. 31, 2002

(30) Foreign Application Priority Data

Feb. 19, 2001 (JP) ..... 2001-041606
Apr. 18, 2001 (JP) ..... 2001-119213
Aug. 8, 2001 (JP) ..... 2001-240195

(51) Int. Cl.[7] ..... B22D 11/06
(52) U.S. Cl. ..... 164/463; 164/479; 164/480
(58) Field of Search ..... 164/479, 480, 164/428, 429, 463, 423

(56) References Cited

U.S. PATENT DOCUMENTS 3,856,513 A * 12/1974 Chen et al. ..... 148/403
4,259,270 A * 3/1981 Winter et al. ..... 75/334
4,473,105 A * 9/1984 Pryor ..... 164/467
5,427,173 A * 6/1995 Das et al. ..... 164/463
2002/0127426 A1 * 9/2002 Buxbaum ..... 428/670

FOREIGN PATENT DOCUMENTS

| | | |
|---|---|---|
| JP | 1-262924 | 10/1989 |
| JP | 4-29728 | 1/1992 |
| JP | 6-254361 | 9/1994 |
| JP | 11-276866 | 10/1999 |

* cited by examiner

*Primary Examiner*—Kuang Y. Lin
(74) *Attorney, Agent, or Firm*—Armstrong, Westerman & Hattori, LLP

(57) ABSTRACT

The invention provides a process for producing vanadium alloy foil suitable as a membrane in a hydrogen-refining unit. A vanadium alloy comprising 5 to 25% by weight of at least one selected from the group consisting of Ni, Co, Mo, Fe and Ag, 0.01 to 5% by weight of at least one selected from the group consisting of Ti, Zr and Y, and the balance being V is used. A melt of the vanadium alloy is prepared by use of a crucible 1 having slit 3 in the bottom, a roll 2 comprising a cylinder whose central axis is arranged to be parallel to the slit is rotated, the melt is jetted from the slit 3 to the roll surface 5, the melt is jetted from the slit 3 is rapidly cooled, and the vanadium alloy solidified on the roll surface 5 is continuously exfolitated from the roll surface 5 to obtain the foil.

6 Claims, 2 Drawing Sheets

PROCESS FOR PRODUCING VANADIUM ALLOY FOIL

BACKGROUND OF THE INVENTION

1. Field of the Invention

The present invention relates to metallic foil useful as a hydrogen-permeable film (membrane) in a hydrogen-refining unit used in fields related to fuel cells and semiconductors.

2. Background Art

In recent years, as a countermeasure against global warming, there is demand for practical use and spread of a hydrogen-refining unit and fuel cells utilizing the same. Such a hydrogen-refining unit includes first and second chambers, and the first chamber is separated via a membrane from the second chamber. When a hydrogen-containing gas is passed through the first chamber, the membrane permits hydrogen to be substantially permeated therethrough, whereby a hydrogen-enriched gas is collected in the second chamber while a gas containing impurities (CO, $CO_2$ etc.) remains in the first chamber. As described above, the membrane in the hydrogen-refining unit should be hydrogen-permeable.

As such membrane, palladium alloy (e.g. Pd—Cu) foil capable of occluding hydrogen has been used. The palladium alloy foil has excellent hydrogen permeability, but because palladium is relatively expensive, there is a need for a substitute made of a cheaper material than the palladium alloy foil.

As a substitute for the palladium alloy, a vanadium alloy (V—Ni—Ti, V—Ni—Zr) has been examined. However, the vanadium alloy is poor in rolling ability so that when vanadium alloy foil is produced by rolling molding, special rolling conditions and repetition of an annealing step are necessary, thus increasing production costs. Further, if annealing is repeated in producing the foil, element distribution in the foil may be segregated. Moreover, such procedures should be conducted in an inert gas atmosphere in order to prevent oxidation of the vanadium alloy, but the facilities should be large-scaled when conducting the rolling and annealing steps in an inert-gas atmosphere. In addition, the vanadium alloy foil produced by rolling molding is low in toughness and poor in processability and durability.

SUMMARY OF THE INVENTION

The object of the present invention is to provide a process for producing vanadium alloy foil excellent in hydrogen permeability and processability, free from segregation of element distribution in the foil, and useful as a membrane in a hydrogen-refining unit.

To solve the problem described above, the inventors of the present application made extensive study, and as a result, they found that the problem can be solved by a process for producing foil of a vanadium alloy comprising 5 to 25% by weight of at least one selected from the group consisting of Ni, Co, Mo, Fe and Ag, and 0.01 to 5% by weight of at least one selected from the group consisting of Ti, Zr and Y, the balance being V, which comprises the steps of:

preparing a melt of the vanadium alloy by use of a crucible having a slit in the bottom, rotating a roll comprising a cylinder whose central axis is arranged to be parallel to the slit, jetting the melt from the slit to the roll surface of the rotating roll and rapidly cooling the melt jetted from the slit, and continuously exfoliating the vanadium alloy solidified on the roll surface from the roll surface to obtain the foil.

Figure 1:
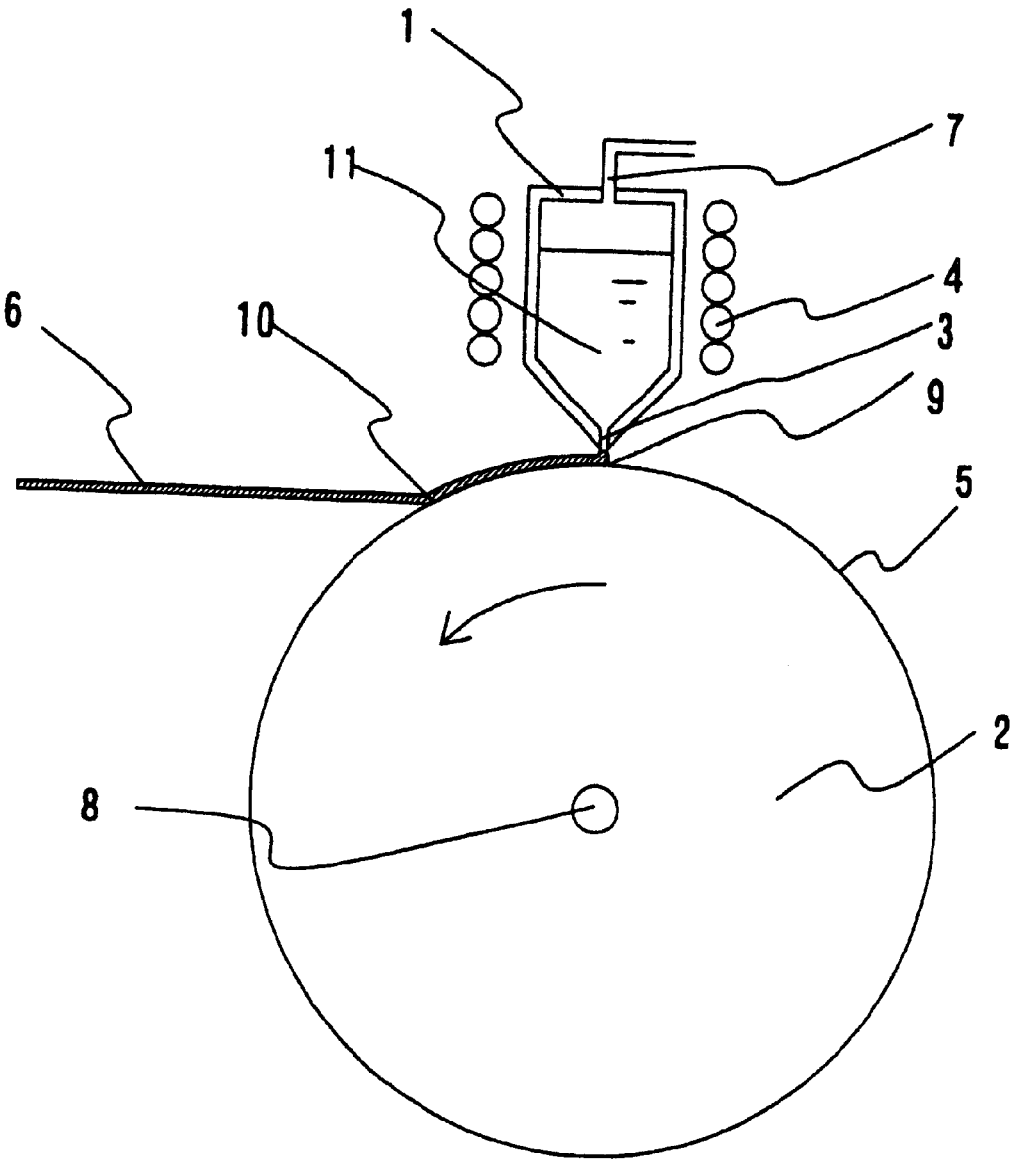
FIG. 1 is an illustration of an apparatus for producing the vanadium alloy foil of the present invention.

In the drawings, 1 is a crucible, 2 is a roll, 3 is a slit, 4 is a radiofrequency induction heater, 5 is a roll surface, 6 is foil, 7 is a pressurizing gas inlet, and 11 is a melt.

DETAILED DESCRIPTION OF THE PREFERRED EMBODIMENTS

Hereinafter, the present invention is described in more detail.

In the present invention, a vanadium alloy comprising at least one selected from the group consisting of Ni, Co, Mo, Fe and Ag, at least one selected from the group consisting of Ti, Zr and Y, and the balance being V, is used. Such a vanadium alloy is excellent in hydrogen permeability and useful as the membrane in a hydrogen-refining unit.

Further, the vanadium alloy used in the present invention may further comprise Si and B if necessary.

In addition, the vanadium alloy used in the present invention may further comprise, if necessary, at least one selected from the group consisting of Ru, Rh, Pd, Os, Ir, Pt, Au, Cu, Cr and W.

Moreover, the vanadium alloy used in the present invention may further comprise, if necessary, at least one selected from the group consisting of In, Sn and Bi.

In the present invention, the total of Ni, Co, Mo, Fe and Ag compounded in the vanadium alloy is 5 to 25% by weight. The vanadium alloy containing Ni, Co, Mo, Fe and Ag in the above range shows good hydrogen permeability.

Further, in the present invention, the total of Ti, Zr and Y compounded in the vanadium alloy is 0.01 to 5% by weight. By adding at least one selected from Ti, Zr and Y in the above range in the vanadium alloy, prevention of the oxidation of the resulting vanadium alloy foil can be achieved.

When Si and B are further contained in the vanadium alloy of the present invention, the total of such elements compounded therein is 0.01 to 1% by weight. When Si and B are contained in the above range, a melt of the resultant vanadium alloy has lower viscosity, thus good foil can be obtained by the method described below.

When at least one selected from the group consisting of Ru, Rh, Pd, Os, Ir, Pt, Au, Cu, Cr and W is further contained in the vanadium alloy of the present invention, the amount of such elements compounded therein is 0.01 to 5% by weight. Thereby, good foil can be obtained by the method described below.

When at least one selected from the group consisting of In, Sn and Bi is further contained in the vanadium alloy of the present invention, the amount of such elements compounded therein is 0.01 to 5% by weight. The melting point is thereby lowered, and good flexible foil can be obtained.

The vanadium alloy foil of the present invention is produced by the apparatus shown schematically in FIG. 1.

The apparatus shown in FIG. 1 is provided with crucible 1. The crucible 1 is composed of a concave part and a lid with which the crucible 1 can be closed. Although the material of this crucible is not particularly limited, the crucible is composed of a material which is endurable to high temperatures at which the vanadium alloy in the concave part is melted, and which does not chemically react with the melt. A preferable material of the crucible is, for example, boron nitride-based ceramics.

The crucible 1 is provided therearound with a heating means for heating the crucible. This heating means is not particularly limited insofar as the vanadium alloy in the crucible can be heated at the melting point or more. The apparatus shown in FIG. 1 is provided with a radiofrequency induction heater 4 consisting of a radiofrequency coil as a heating means. In the radiofrequency induction heater 4, the melt in the crucible is stirred through convection so that while the temperature distribution is kept uniform, the vanadium alloy can be rapidly melted. When a thermocouple is arranged in the crucible, the temperature of the vanadium alloy melt in the crucible can be confirmed.

According to the present invention, the crucible 1 is provided with a gas inlet 7. Once the vanadium alloy charged in the crucible is completely melted, the crucible is pressurized with a gas introduced through the inlet 7. The gas introduced through the inlet 7 is inert for preventing oxidation of the melted vanadium alloy. Particularly preferable examples of this inert gas include nitrogen, helium, argon and hydrogen, among which an argon gas is particularly preferable.

Although the pressure in the crucible upon introduction of a gas into the crucible is not particularly limited, the pressure in the crucible is preferably 0.01 to 0.1 MPa.

According to the present invention, the bottom of the crucible is provided with slit 3. Through the slit 3, the melt in the crucible can be jetted toward the roll surface 5 of the rotating roll 2 described below. This slit is closed until the vanadium alloy charged in the crucible is completely melted. The means of closing this slit is not particularly limited. In the present invention, it is not always necessary that as shown in FIG. 1, the slit is in the form of a nozzle protruding from the bottom of the crucible.

Although the width of slit 3 is not particularly limited, the width of the slit is preferably 0.1 to 0.6 mm, more preferably 0.2 to 0.5 mm and most preferably 0.3 to 0.4 mm. The foil having desired thickness can thereby be obtained. Further, the length of the slit 3 is not particularly limited, and the length of the slit can be suitably designed and changed depending on the dimension of the roll.

According to the present invention, a cylindrical roll 2 is arranged below the slit as shown in FIG. 1. The roll 2 is arranged such that the central axis 8 is parallel to the slit 3 of the crucible, and simultaneously the roll is installed so as to revolve on the central axis 8. The melt 1 jetted from slit 3 is to be sprayed onto the rotating roll surface 5. That is, the melt jetted from the slit is rapidly cooled by contact with the roll surface at the first point 9 on the roll surface, to form a foil layer on the roll surface. The roll is rotated at a predetermined rotational speed, and the foil layer is continuously exfoliated at the second point 10 on the roll surface to obtain foil 6. The exfoliated foil is then collected in a chamber (not shown).

In the present invention, the relationship in relative position between the slit 3 and the roll 2 is not particularly limited insofar as the slit 3 is parallel to the central axis of the roll and the roll surface is positioned in the direction of jetting from the slit.

Figure 2:
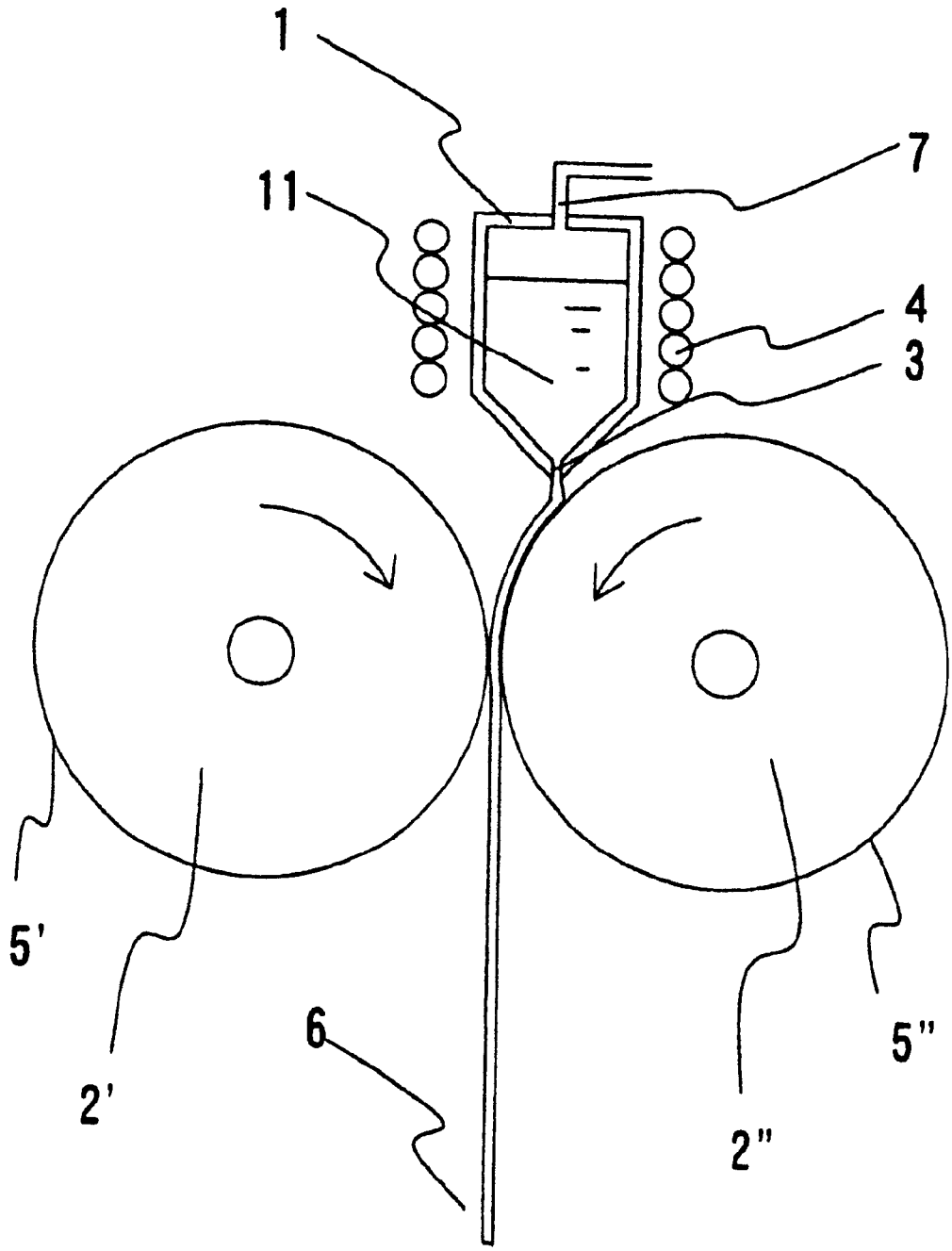
FIG. 2 is an illustration of another apparatus for producing the vanadium alloy foil of the present invention.

In the present invention, not only the case where the apparatus including one roll 2 (single-roll type) as shown in FIG. 1 is used, but the apparatus equipped with two rolls 5' and 5" (twin-roll type) as shown in FIG. 2 may also be used. In the apparatus shown in FIG. 2, the first roll 2' is arranged to be parallel to the second roll 2", and the first roll 2' and the second roll 2" are mutually rotated inward to deliver the foil downward. When the melt in the crucible is jetted from slit 3 toward between the first and second rolls, the melt is rapidly cooled by contact with either the first roll 2' or second roll 2", or both of them to form a foil layer on the roll surfaces 5' and 5". The foil layer thus formed on the foil layer is continuously exfoliated from the roll surfaces to obtain foil.

According to the present invention, the roll should rapidly cool the melt jetted from the slit, and it should be composed of a highly thermally conductive material such as copper. In the inside of the roll, a hole for passing a coolant such as water may be formed.

According to the present invention, the roll surface 5 should be continuous. In addition, the roll surface should be smooth enough to allow the foil layer formed on the roll surface to exfoliate from the roll surface.

In the present invention, the rotational speed of roll 2 is not particularly limited, but preferably, roll 2 is rotated to allow transfer of the roll surface 5 at a rate of 450 to 20000 m/min. The melt jetted from the slit can thereby rapidly cooled to form good foil.

By regulating the jetted amount of the melt, the width of the slit and the rotational speed of the roll, the thickness of the resultant vanadium alloy foil can be arbitrarily designed and changed in the present invention. The thickness of the vanadium alloy foil obtained in the present invention is 5 to 1000 $\mu$m but is not particularly limited. In particular, when the thickness of the vanadium alloy foil obtained by the present invention is 5 to 25 $\mu$m, the vanadium alloy constituting this foil is amorphous. The foil of the amorphous vanadium alloy is particularly useful as the membrane in a hydrogen-refining unit.

According to the present invention, the apparatus including the crucible and roll is arranged in an inert gas such as argon. Therefore, oxidation of the resultant vanadium alloy foil can be prevented.

EXAMPLE

According to the present invention, vanadium alloy foil was prepared by a single-roll apparatus.

Crucible 1 was made of boron nitride-based ceramics and had a slit of 0.4 mm in width and 30 mm in length. Roll 2 was made of copper and had a dimension of 300 mm in diameter and 50 mm in length. The distance between the roll surface 5 and slit 3 was 0.5 mm. The roll was cooled with water. The number of revolutions of the roll was set at 500 rpm.

A vanadium alloy of 83 V—17 Ni—0.04 Ti (% by weight) was charged into the crucible. The vanadium alloy was completely melted by heating the crucible at 1750° C. Thereafter, an argon gas was introduced into the crucible, and the melt was jetted from the slit. The pressure in the crucible was 0.05 MPa.

The melt was jetted from the slit to form a foil layer on the roll surface, and this foil layer was continuously exfoliated from the roll to obtain sample 1. The thickness of sample 1 was 0.2 mm.

Samples 2 to 6 in accordance with the present invention were prepared under the conditions shown in Table 1. The evaluation items for the samples, as well as methods therefor, are shown as follows.

Surface condition: The surface was observed on a microscope, and its smoothness was evaluated.

Occurrence of pinholes: A dye solution was prepared by dissolving an oil red dye in a solvent at a concentration of 1 g/L. A sample was placed on an absorbent paper in a sufficiently ventilated draft (chamber), and the dye solution was applied by a brush onto the sample. Five minutes thereafter, the sample was removed, and it was confirmed whether dyed points were formed on the absorbent paper.

Segregation of element distribution in the foil: Occurrence of segregation of element distribution in the foil was examined by EPMA (electron probe microanalysis).

Crystal structure: The crystal structure was analyzed by X-ray diffraction.

TABLE 1

| | Example 1 | | | | | |
|---|---|---|---|---|---|---|
| | Sample 1 | Sample 2 | Sample 3 | Sample 4 | Sample 5 | Sample 6 |
| Number of revolutions of the cylinder (rpm) | 500 | 1000 | 3000 | 5000 | 7000 | 9000 |
| Temperature in the crucible (° C.) | 1750 | 1750 | 1750 | 1750 | 1750 | 1750 |
| Pressure in the crucible (Mpa) | 0.05 | 0.05 | 0.05 | 0.05 | 0.05 | 0.05 |
| Thickness of the resultant foil (mm) | 0.2 | 0.1 | 0.075 | 0.05 | 0.025 | 0.01 |
| Surface condition | good | good | good | good | good | good |
| Occurrence of pinholes | none | none | none | none | none | none |
| EPMA analysis | no aggregation | no aggregation | no aggregation | no aggregation | no aggregation | no aggregation |
| Crystal structure | crystal | crystal | crystal | crystal | amorphous | amorphous |

All samples 1 to 6 obtained in accordance with the present invention had uniform thickness. The surface condition was also good, and no pinhole was confirmed. In particular, samples 5 and 6 having a thickness of 25 μm or less were free from segregation of element distribution in the foil, and their crystal structure was amorphous, and it was found that these samples were useful as the membrane in a hydrogen-refining unit. Further, the thickness distribution in the width direction of sample 5 foil was 25±2.5 μm, and the thickness distribution in the width direction of sample 6 foil was 10±1.0 μm.

What is claimed is:

1. A process for producing foil of a vanadium alloy comprising 5 to 25% by weight of at least one selected from the group consisting of Ni, Co, Mo, Fe and Ag, 0.01 to 5% by weight of at least one selected from the group consisting of Ti, Zr and Y, and the balance being V, which comprises the steps of:

preparing a melt of the vanadium alloy by use of a crucible having a slit in the bottom, rotating a roll comprising a cylinder whose central axis is arranged to be parallel to the slit, jetting the melt from the slit to the roll surface of the rotating roll and rapidly cooling the melt jetted from the slit, and continuously removing the vanadium alloy solidified on the roll surface from the roll surface to give foil of the vanadium alloy.

2. The process according to claim 1, wherein said vanadium alloy further comprises 0.01 to 1% by weight of Si and/or B.

3. The process according to claim 1, wherein said vanadium alloy further comprises 0.01 to 5% by weight of at least one selected from the group consisting of Ru, Rh, Pd, Os, Ir, Pt, Au, Cu, Cr and W.

4. The process according to claim 1, wherein said vanadium alloy further comprises 0.01 to 5% by weight of at least one selected from the group consisting of In, Sn and Bi.

5. The process according to claim 1, wherein said roll is rotated such that said roll surface is moved at a rate of 450 to 20000 m/min.

6. The process according to claim 1, wherein said foil having an amorphous crystal structure is produced.

* * * * *